US008579217B2

(12) United States Patent
Chesack

(10) Patent No.: US 8,579,217 B2
(45) Date of Patent: Nov. 12, 2013

(54) FLUSHING WATER CONTROL FOR A FOOD WASTE DISPOSER BASED ON VISUAL DETECTION OF FOOD WASTE

(75) Inventor: Gregory J. Chesack, Kenosha, WI (US)

(73) Assignee: Emerson Electric Co., St. Louis, MO (US)

( * ) Notice: Subject to any disclaimer, the term of this patent is extended or adjusted under 35 U.S.C. 154(b) by 353 days.

(21) Appl. No.: 12/959,443

(22) Filed: Dec. 3, 2010

(65) Prior Publication Data

US 2011/0133005 A1 Jun. 9, 2011

Related U.S. Application Data

(60) Provisional application No. 61/267,874, filed on Dec. 9, 2009.

(51) Int. Cl.
*B02C 9/04* (2006.01)
*B02C 23/06* (2006.01)

(52) U.S. Cl.
USPC ..... 241/33; 241/36; 241/46.013

(58) Field of Classification Search
USPC ..... 241/33, 36, 46.013
See application file for complete search history.

(56) References Cited

U.S. PATENT DOCUMENTS

| | | | | | |
|---|---|---|---|---|---|
| 2,012,680 | A | * | 8/1935 | Hammes | 241/46.06 |
| 3,344,996 | A | * | 10/1967 | Meyers | 241/36 |
| 3,374,957 | A | * | 3/1968 | Tyler | 241/33 |
| 3,510,069 | A | * | 5/1970 | Hannum | 241/33 |
| 3,545,684 | A | | 12/1970 | Hilmanowski | |
| 5,308,000 | A | | 5/1994 | Riley | |

OTHER PUBLICATIONS

PCT International Search Report and Written Opinion of the International Searching Authority, mailed Mar. 15, 2011.

* cited by examiner

*Primary Examiner* — Faye Francis
(74) *Attorney, Agent, or Firm* — Harness, Dicky & Pierce, P.L.C.

(57) ABSTRACT

Visual detection of food waste is used to control flow of flushing water to a food waste disposer. When the disposer is turned on, flushing water is also turned on at a low flow rate. The flushing water is directed into the food waste disposer. A visual detection sensor, which is coupled to a controller, is oriented to detect food waste entering the food waste disposer. Upon detection of the presence of food waste, the controller changes the rate of flow of the flushing water from the low flow rate to a high flow rate. The controller maintains the flow rate of the flushing water at the high flow rate for as long as food waste is detected as entering the food waste disposer and for a period after food waste is no longer detected to allow the food waste to be comminuted and flushed from the food waste disposer.

13 Claims, 3 Drawing Sheets

FLUSHING WATER CONTROL FOR A FOOD WASTE DISPOSER BASED ON VISUAL DETECTION OF FOOD WASTE

CROSS-REFERENCE TO RELATED APPLICATIONS

This application claims the benefit of U.S. Provisional Application No. 61/267,874, filed on Dec. 9, 2009. The entire disclosure of the above application is incorporated herein by reference.

FIELD

The present disclosure relates to commercial food waste disposers, and in particular, to controlling the flow of flushing water provided to them.

BACKGROUND

This section provides background information related to the present disclosure which is not necessarily prior art.

Commercial food waste disposers such as those used in restaurants typically have a source of flushing water provided to them, either directly or to the sink to which the food waste disposer is attached. Various systems for controlling the flow of this flushing water are known. One such system is described in U.S. Pat. No. 5,308,000, a portion of which follows.

With reference to FIG. 1 of U.S. Pat. No. 5,308,000, a commercial food waste disposer 10 of conventional design is shown. Disposer 10 is connected in conventional fashion to a drain opening 14 of a sink 12. An outlet 16 is connected to a sanitary sewer system. Disposer 10 includes an upper grind chamber 13 and an electric motor 18 that powers a grind mechanism (not shown) in the grind chamber. Conduit 28 which includes parallel branches 27 and 29 and valves 36, 40 is connected to a source of flushing water that is discharged into grind chamber 13.

Referring to FIG. 2 of U.S. Pat. No. 5,308,000, motor 18 is connected to an AC power source 22. The flow of electrical current through motor windings 20 is controlled by a switch 23. Electrical lead wires 24 and 26 are, thus, energized when switch 23 is closed. A schematically illustrated current sensor 30 is provided to sense the flow of current through winding 20 and hence through lead 24. In the illustrated embodiment, a toroid 32 is shown as an example of an induction operated device that responds to the flow of current through lead 24 and causes a switch 33 to be closed whenever a grind load is placed in disposer 10. It will be further noted in FIG. 2 that when switch 23 is closed, a first solenoid 34 is energized and causes opening of a valve 36 allowing water to flow at a low rate through conduit 27 and into grind chamber 13. It will be apparent that solenoid 34 is, thus, activated whenever there is power provided to motor winding 20. Valve 36 is preferably designed so that approximately one to two gallons per minute of water will flow through conduit 27.

When a grind load is encountered by the passage of material from sink 12 into disposer 10, the increased current flow through winding 20 is sensed by current sensor 30. Current sensor 30 causes a second solenoid 38 to open valve 40 allowing water to flow through conduit 29. Valve 40 and conduit 29 are configured so that water will flow at a relatively higher rate, preferably in the range of about 3 to 7 gallons per minute. When the grind load has discontinued the flow of current through winding 20 diminishes to the point that switch 33 is once again opened due to a drop in the current induced in toroid 32. This causes valve 40 to once again be closed thereby conserving water when no grind load is sensed. A time delay can be designed into the circuitry so that valve 40 will not be closed until there has been no grind load detected for a selected period of time, for example 10 seconds. This will help ensure the thorough flushing of ground materials out of outlet 16.

In the further embodiment of FIG. 3 of U.S. Pat. No. 5,308,000, a current detector 48 is connected to a variable solenoid 50 that will progressively increase the opening of a valve 52 in response to the amount of current flowing through motor windings 20. With this arrangement, sensor 48 can be utilized to trigger a low rate of flow in the one to two gallon range through conduit 28 when switch 23 is closed. As increased amounts of current flow through winding 20, variable solenoid 50 can be set to allow progressively increasing amounts of water to flow through conduit 28 into the grind chamber 13.

Current sensors 30 and 48 can be of various types. Preferably an induction operated device is used such as a current transformer, watt meter, or if desired, an ammeter. A preferred type of sensor is marketed by Solid State Advance Controls, Inc. as an "alternating current sensor" and is provided with adjustable sensitivity. As previously noted, a number of solenoids greater than two can be utilized. Thus, for example, if low, medium and high rates of water flow are desired, three solenoids are used instead of two.

It should be understood that types of valves other than solenoid valves can be used, such as pneumatically or hydraulically controlled valves.

While the above described system advantageously conserves water by controlling the flow of flushing water to disposer 10, it uses motor current as the basis for controlling the water supply. In some instances, such as where the grind load is light, the load placed on the motor when the food waste is being ground may not be large enough to cause a sufficient change in motor current so as to trigger the detection system.

SUMMARY

This section provides a general summary of the disclosure, and is not a comprehensive disclosure of its full scope or all of its features.

In accordance with an aspect of the present disclosure, visual detection of food waste is used to control flow of flushing water to a food waste disposer. When the disposer is turned on, flushing water is also turned on at a low flow rate. The flushing water is directed into the food waste disposer, either by being directed into a sink to which the food waste disposer is attached, or directly into the food waste disposer. A visual detection sensor, which is coupled to a controller, is oriented to detect food waste entering the food waste disposer, such as when food waste is present at an inlet of the food waste disposer. Upon detection of the presence of food waste, the controller changes the rate of flow of the flushing water from the low flow rate to a high flow rate. The controller maintains the flow rate of the flushing water at the high flow rate for as long as food waste is detected as entering the food waste disposer and for a period after food waste is no longer detected to allow the food waste to be comminuted and flushed from the food waste disposer. In an aspect, after the predetermined period of time, the controller changes the flow rate to the low flow rate.

In an aspect, the visual detection sensor is oriented to point into the flow path of the flushing water flowing into the inlet of the food waste disposer. A beam of the visual detection sensor is reflected back to the sensor by the presence of food waste but not by just water flow.

In an aspect, the controller controls low and high flow valves coupled to the source of flushing water to provide the low and high flow rates. In an aspect, the low flow valve is controlled to be on and the high flow valve controlled to be off to provide the low flow rate. In an aspect, the low flow valve is controlled to be off and the high flow valve controlled to be on to provide the high flow rate. In an aspect, both the low flow valve and high flow valve are controlled to be on to provide the high flow rate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
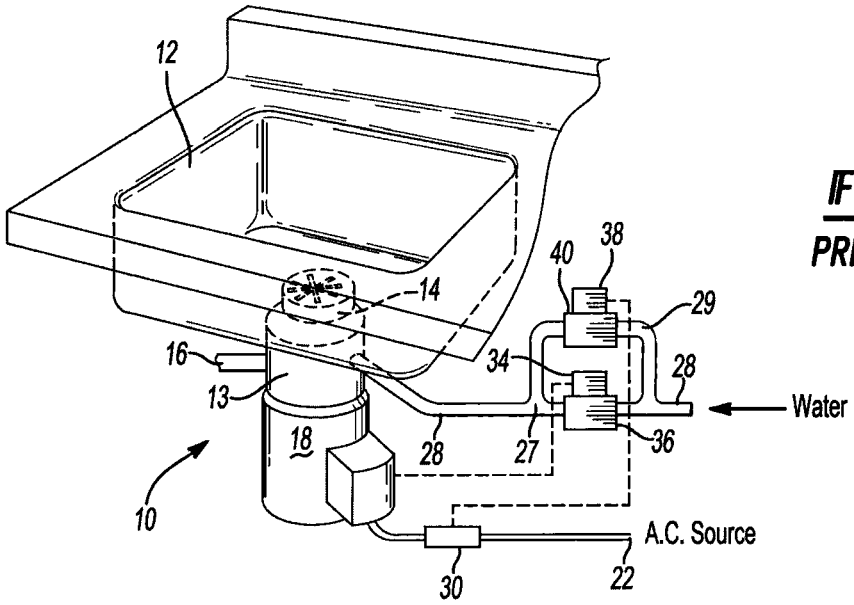
Fig-1 PRIOR ART
FIG. 1 is an illustration of a prior art commercial food waste disposer installed to a sink.
Figure 2:
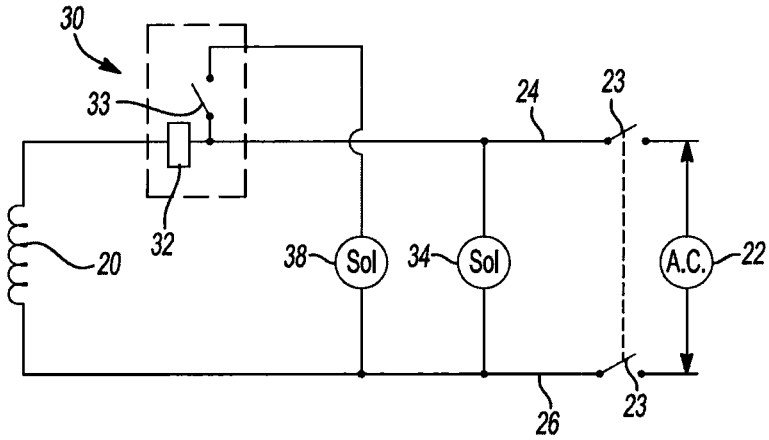
Fig-2 PRIOR ART
FIG. 2 is an electrical schematic of a control circuit for the food waste disposer of FIG. 1.
Figure 3:
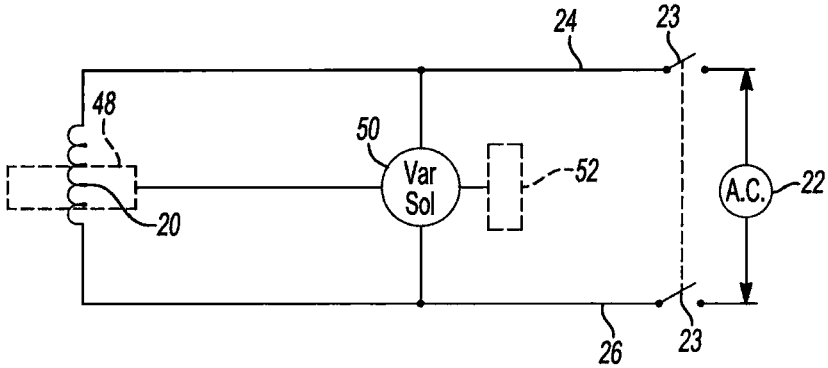
Fig-3 PRIOR ART
FIG. 3 is an electrical schematic of second control circuit for the food waste disposer of FIG. 1.

Example embodiments will now be described more fully with reference to the accompanying drawings. The following description is merely exemplary in nature and is in no way intended to limit the disclosure, its application, or uses. For purposes of clarity, the same reference numbers will be used in the drawings to identify similar elements.

Figure 4:
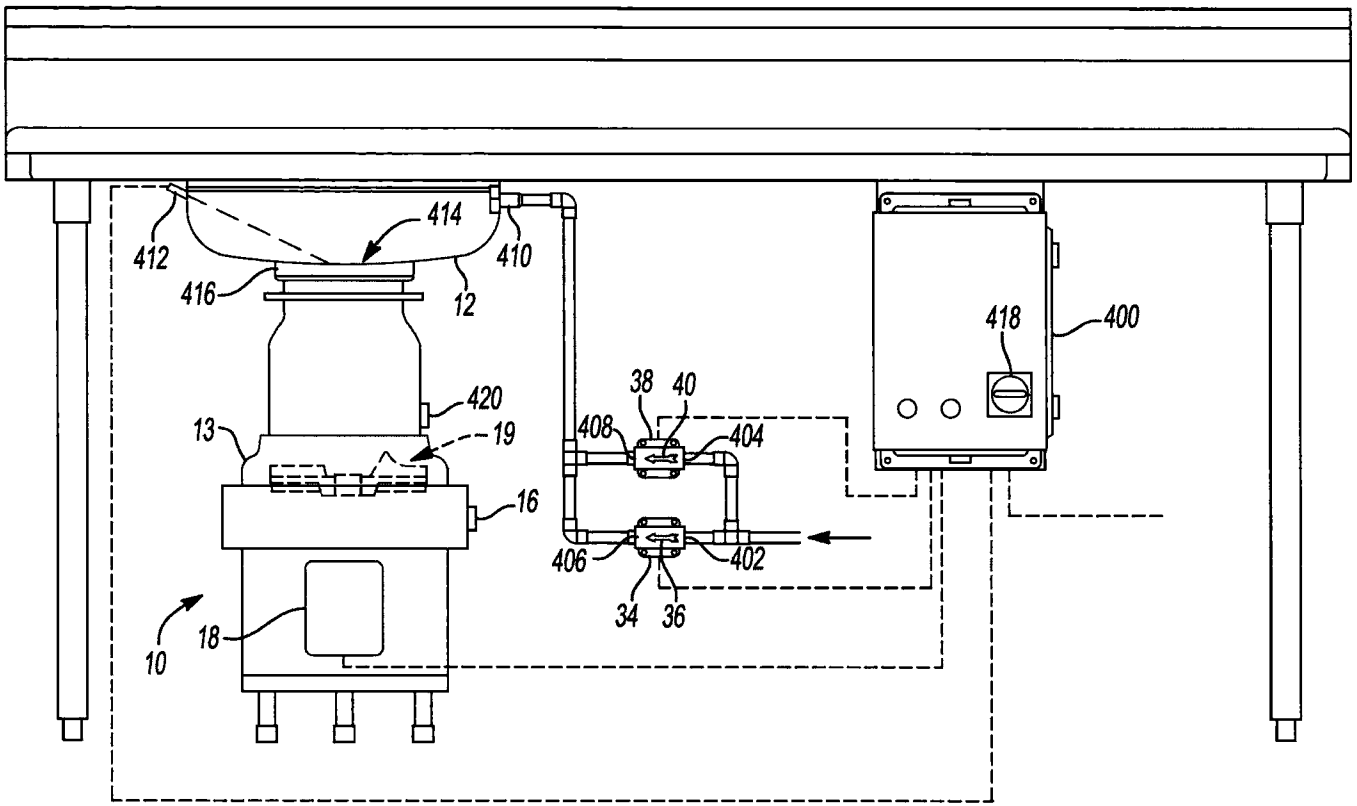
FIG. 4 is an illustration of a commercial food waste disposer installed to a sink in accordance with an aspect of the present disclosure.

In accordance with an aspect of the present disclosure, water flow of the flushing water is controlled based on the visual detection of food waste entering disposer 10. With reference to FIG. 4, motor 18 of disposer 10 is coupled to an output of controller 400. Solenoid 34 of valve 36 (referred to hereinafter as "low flow valve 36") and solenoid 38 of valve 40 (referred to hereinafter as "high flow valve 40") are also coupled to outputs of controller 400. Inlet 402 of low flow valve 36 and inlet 404 of high flow valve 40 are coupled to a water source (not shown). Outlet 406 of low flow valve 36 and outlet 408 of high flow valve 40 are coupled to a flushing water inlet 410 in sink 12. It should be understood that the outlets 406, 408 of low flow valve 36 and high flow valve 40 can be coupled to disposer 10, such as shown in FIG. 1, so that flushing water flows directly into grind chamber 13 instead of first flowing into sink 12. Disposer 10 may include a dishwasher inlet 420.

A visual detection sensor 412 is coupled to an input of controller 400. Visual detection sensor 412 may illustratively be a photo-sensor having a light source and a light detector. For example, visual detection sensor 412 may illustratively be a photoelectric proximity switch model VTE18-4P8240V available from SICK, Inc. of Minneapolis, Minn. Visual detection sensor 412 is oriented so that a light beam from its light source is directed to inlet 414 of disposer 10, illustratively, into a baffle 416 of disposer 10 at inlet 414 of disposer 10. Baffle 416 is made of a dark resilient material, such as a black elastomer. The wavelength of the light beam from visual detection sensor 412 is such that baffle 416, being a dark color such as black, does not reflect a sufficient amount of the light beam back to visual detection sensor 412 to trigger the light detector of visual detection sensor 412. On the other hand, food waste present at inlet 414 reflects a sufficient amount of the light beam back to visual detection sensor 412 to trigger the light detector of visual detection sensor 412. Illustratively, visual detection sensor 412 provides an infrared light beam.

It should be understood that other types of visual detection sensors can be used for visual detection sensor 412. For example, a visual detection sensor that has a light source and light detector where the light source is reflected from a reflector back to the light source can be utilized. With this type of visual detection sensor, a reflector would be provided at an appropriate location in sink 12 or inlet 414 of disposer 10, such as on an inner surface of baffle 416 on a side opposite to where visual detection sensor 412 is mounted. The light beam from the light source would be reflected back to the light sensor when food waste is not present. When food waste is present, the light beam would be broken triggering the visual detection sensor to provide a signal to controller 400 indicative of the light beam being broken. A visual detection sensor having a light source and a sensor that are mounted spaced from each other can be utilized. With this type of visual detection sensor, the light sensor may illustratively be mounted in baffle 416 on a side opposite to where the light source of visual detection sensor 412 is mounted, or vice-versa. When food waste is not present, the light beam from the light source would hit the light sensor. The presence of food waste would break the light beam triggering the visual detection sensor to provide a signal to controller 400 indicative of the light beam being broken.

Controller 400 may be part of or include a processor (shared, dedicated, or group) and/or memory (shared, dedicated, or group) that execute one or more software or firmware programs, an Application Specific Integrated Circuit (ASIC), an electronic circuit, a combinational logic circuit, and/or other suitable components that provide the requisite control functionality.

Figure 5:
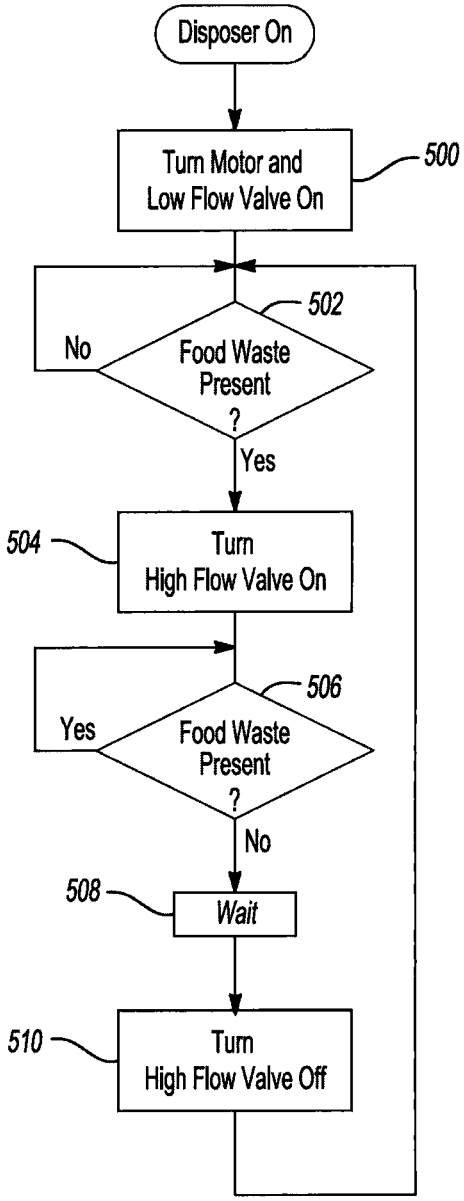
FIG. 5 is a flow chart of a control program in accordance with an aspect of the present disclosure for the food waste disposer of FIG. 4.

FIG. 5 is a flow chart of an illustrative program for controller 400. When disposer 10 is turned on, such as by a switch 418 coupled to controller 400 being turned to an "on" position by a user, at 500 controller 400 energizes motor 18, that powers grind mechanism 19 in grind chamber 13, and energizes solenoid 34 of low flow valve 36 to open low flow valve 36. Flushing water is then provided at a low flow rate to sink 12 where it flows into inlet 414 of disposer 10. At 502, controller 400 checks whether food waste is present at inlet 414 of disposer 10. It does so based on a signal provided by visual detection sensor 412. When visual detection sensor 412 senses that food waste is present at inlet 414 of disposer 10, it provides a signal indicative that food waste is present at inlet 414 to controller 400. Upon visual detection sensor 412 sensing food waste at inlet 414, controller 400 at 504 energizes solenoid 38 of high flow valve 40. Flushing water is then provided at a high flow rate to sink 12 and thus to disposer 10. In this regard, controller 400 can keep solenoid 34 of low flow valve 36 energized or de-energize solenoid 34. At 506, controller 400 checks whether food waste is still present at inlet 414 of disposer 10 and continues to check for as long as food waste is still present. Once food waste is no longer present at inlet 414 of disposer 10, controller 400 waits a predetermined period at 508 and then at 510 de-energizes solenoid 38 of high flow rate valve 40. In this regard, controller 400 keeps solenoid 38 of high flow valve 40 energized for as long as visual detection sensor 412 senses that food waste is present at inlet 414 of disposer 10, and for a period of time thereafter so that the food waste will be comminuted by disposer 10 and flushed out through outlet 16 before the flow rate of the flushing water is returned to the low flow rate.

As used herein low and high flow rates mean flow rates where the high flow rate is at least fifty percent higher than the low flow rate. By way of example and not of limitation, the low flow rate may be in the range of 1-2 gallons per minute and the high flow rate may be in the range of 3-7 gallons per minute.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A food waste disposer system, comprising:

a grind chamber having a grind mechanism powered by an electric motor;

an inlet through which food waste is introduced into the grind section;

a valve that controls the flow of flushing water to the disposer from a source of flushing water, the valve coupled to a controller;

a visual detection sensor that visually detects the presence of food waste at the inlet, the visual detector coupled to the controller, wherein the visual detection sensor is a photo-sensor having a light source and a light detector, the photo-sensor oriented so that light from the light source is directed at the inlet of the disposer about which a baffle is disposed and reflected by food waste at the inlet to the light detector to trigger the light detector, the baffle made of a dark material that itself does not reflect sufficient light from the light source back to the light detector to trigger the light detector; and the controller responsive to the visual detection sensor detecting the presence of food waste at the inlet of the disposer and controlling the valve to increase the flow of flushing water supplied to the food waste disposer.

2. The apparatus of claim 1 wherein the valve is a high flow valve, the apparatus further including a low flow valve that also controls the flow of flushing water to the disposer, the controller responsive to the disposer being turned on to control the low flow valve and high flow valve to provide flushing water at a low flow rate to the disposer, the controller responsive to the visual detection sensor detecting the presence of food waste at the inlet of the disposer to control the low flow valve and high flow valve to provide flushing water at a high flow rate to the disposer.

3. The apparatus of claim 2 wherein the controller controls the low flow valve to be open and the high flow valve to be closed to provide flushing water at the low rate to the disposer and controls the low flow valve to be closed and the high flow valve to be open to provide flushing water at the high flow rate to the disposer.

4. The apparatus of claim 2 wherein the controller controls the low flow valve to be open and the high flow valve to be closed to provide flushing water at the low rate to the disposer and controls the low flow valve and the high flow valve to both be open to provide flushing water at the high flow rate to the disposer.

5. The apparatus of claim 2 wherein the controller is responsive to the visual detection sensor detecting the absence of food waste at the inlet of the disposer after flushing water has been provided to the disposer at the high flow rate and after an elapse of a predetermined period of time controls the low flow valve and high flow valve to provide flushing water to the disposer at the low flow rate.

6. A method of controlling the flow of flushing water to a food waste disposer, comprising:

detecting with a visual detection sensor whether food waste is present at an inlet of the disposer; and determining with a controller whether the disposer has been turned on and upon determining that the disposer has been turned on, controlling the controller a high flow valve and a low flow valve to provide flushing water at a low flow rate to the disposer and controlling with the controller responsive to the visual detection sensor detecting the presence of food waste at the inlet of the disposer the low flow valve and high flow valve to provide flushing water at the high flow rate in response to the presence of food waste at the inlet of the food waste disposer.

7. The method of claim 6 wherein controlling the low flow valve and high flow valve to provide flushing water at the low flow rate includes controlling the low flow valve to be open and the high flow valve to be closed, and controlling the low flow valve and high flow valve to provide flushing water at the high flow rate includes controlling the low flow valve to be closed and the high flow valve to be open.

8. The method of claim 6 wherein controlling the low flow valve and high flow valve to provide flushing water at the low flow rate includes controlling the low flow valve to be open and the high flow valve to be closed, and controlling the low flow valve and high flow valve to provide flushing water at the high flow rate includes controlling the low flow valve and the high flow valve to both be open.

9. The method of claim 6 including detecting with the visual detection sensor whether food waste is no longer present at the inlet of the disposer after food waste has been detected at the inlet of the food waste disposer, and controlling with the controller after an elapse of a predetermined period of time after food waste is no longer present at the inlet the low flow valve and high flow valve to provide flushing water to the disposer at the low flow rate.

10. A food waste disposer system, comprising:

a grind chamber having a grind mechanism powered by an electric motor;

an inlet through which food waste is introduced into the grind section;

a high flow valve that controls the flow of flushing water to the disposer from a source of flushing water and a low flow valve that also controls the flow of flushing water to the disposer, the high and low flow valves valve coupled to a controller;

a visual detection sensor that visually detects the presence of food waste at the inlet, the visual detector coupled to the controller;

the controller responsive to the disposer being turned on to control the low flow valve and high flow valve to provide flushing water at a low flow rate to the disposer, the controller responsive to the visual detection sensor detecting the presence of food waste at the inlet of the disposer to control the low flow valve and high flow valve to provide flushing water at a high flow rate to the disposer in response to the presence of food waste at the inlet of the food waste disposer.

11. The apparatus of claim 10 wherein the controller controls the low flow valve to be open and the high flow valve to be closed to provide flushing water at the low rate to the disposer and controls the low flow valve to be closed and the high flow valve to be open to provide flushing water at the high flow rate to the disposer.

12. The apparatus of claim 10 wherein the controller controls the low flow valve to be open and the high flow valve to be closed to provide flushing water at the low rate to the disposer and controls the low flow valve and the high flow valve to both be open to provide flushing water at the high flow rate to the disposer.

13. The apparatus of claim 10 wherein the controller is responsive to the visual detection sensor detecting the absence of food waste at the inlet of the disposer after flushing water has been provided to the disposer at the high flow rate and after an elapse of a predetermined period of time controls the low flow valve and high flow valve to provide flushing water to the disposer at the low flow rate.

* * * * *